US011203822B2

(12) United States Patent
Lee et al.

(10) Patent No.: US 11,203,822 B2
(45) Date of Patent: Dec. 21, 2021

(54) FABRIC HAVING IMPROVED WINDING PROPERTY AND COMMODITY INCLUDING THE SAME

(71) Applicants: Sung Man Lee, Daegu (KR); Dong Ho Lee, Daegu (KR); Weon Cheol Song, Daegu (KR)

(72) Inventors: Sung Man Lee, Daegu (KR); Dong Ho Lee, Daegu (KR); Weon Cheol Song, Daegu (KR)

( * ) Notice: Subject to any disclaimer, the term of this patent is extended or adjusted under 35 U.S.C. 154(b) by 251 days.

(21) Appl. No.: 16/598,518

(22) Filed: Oct. 10, 2019

(65) Prior Publication Data

US 2021/0010171 A1 Jan. 14, 2021

(30) Foreign Application Priority Data

Jul. 8, 2019 (KR) ..... 10-2019-0082180

(51) Int. Cl.

| | |
|---|---|
| ***D03D 15/587*** | (2021.01) |
| ***D03D 15/00*** | (2021.01) |
| ***D03D 13/00*** | (2006.01) |
| *D03D 15/20* | (2021.01) |

(52) U.S. Cl.

CPC ..... *D03D 15/00* (2013.01); *D03D 13/008* (2013.01); *D10B 2331/04* (2013.01)

(58) Field of Classification Search

CPC .. D03D 15/00; D03D 13/008; D03D 2331/04; D03D 15/47; D03D 15/587; D03D 15/283; D03D 1/00; D03D 13/00; D03D 1/0035; D10B 2321/022; D10B 2505/20; E04D 5/10

See application file for complete search history.

(56) References Cited

U.S. PATENT DOCUMENTS

| | | | | |
|---|---|---|---|---|
| 6,716,778 | B1 * | 4/2004 | Hottner | B32B 5/24 442/199 |
| 10,675,832 | B2 * | 6/2020 | Liu | B32B 5/10 |
| 2003/0134099 | A1 * | 7/2003 | Barrows | A61L 31/12 428/297.4 |
| 2004/0132376 | A1 * | 7/2004 | Haworth | D01F 8/06 442/364 |
| 2005/0142970 | A1 * | 6/2005 | Taniguchi | A47C 5/00 442/189 |
| 2006/0291963 | A1 * | 12/2006 | Theisen | E02D 17/20 405/302.7 |
| 2008/0023015 | A1 * | 1/2008 | Arnold | D04H 1/74 128/899 |
| 2008/0227354 | A1 * | 9/2008 | Yoshida | B29C 43/3642 442/388 |
| 2008/0254244 | A1 * | 10/2008 | Yamaguchi | F16L 57/06 428/36.1 |

(Continued)

FOREIGN PATENT DOCUMENTS

| | | | |
|---|---|---|---|
| JP | 2010189810 | A | 9/2010 |
| KR | 101797525 | B1 | 11/2017 |

*Primary Examiner* — Robert H Muromoto, Jr.

(74) *Attorney, Agent, or Firm* — Harness, Dickey & Pierce, P.L.C.

(57) ABSTRACT

A fabric having an improved winding property, and more particularly to a fabric having an improved winding property, which simultaneously has an excellent winding property and excellent mechanical properties and exhibits an effect of preventing dye migration in fabric coating, and a commodity including the same.

14 Claims, 2 Drawing Sheets

(56) References Cited

U.S. PATENT DOCUMENTS

| | | | | |
|---|---|---|---|---|
| 2009/0183817 | A1* | 7/2009 | Sinykin | B29C 66/91645 156/86 |
| 2012/0251812 | A1* | 10/2012 | Kawka | H04R 9/043 428/222 |
| 2016/0237602 | A1* | 8/2016 | Pritchett | D04B 21/16 |
| 2016/0270898 | A1* | 9/2016 | Noesner | B29C 66/723 |
| 2016/0358690 | A1* | 12/2016 | Liu | D03D 15/54 |
| 2020/0054975 | A1* | 2/2020 | Belmont | D06N 3/0011 |
| 2021/0054537 | A1* | 2/2021 | Ikeda | D01D 5/34 |

* cited by examiner

FABRIC HAVING IMPROVED WINDING PROPERTY AND COMMODITY INCLUDING THE SAME

CROSS-REFERENCE TO RELATED APPLICATION

This application claims priority to and the benefit of Korean Patent Application No. 10-2019-0082180, filed on Jul. 8, 2019, the disclosure of which is incorporated herein by reference in its entirety.

BACKGROUND

1. Field of the Invention

The present invention relates to a fabric having an excellent winding property, and more particularly, to a fabric having an improved winding property, which simultaneously has an excellent winding property, excellent fabric fixability and excellent mechanical properties and exhibits an effect of preventing dye migration in fabric coating, and a commodity including the same.

2. Discussion of Related Art

Generally, waterproofing work is performed on the rooftop or the top of a parking space of a building to prevent leakage, and for the sake of convenience, a roofing sheet for forming a waterproof layer is used to form a waterproof layer by spreading out a waterproof sheet with a specific specification on a base surface.

As an example of the roofing sheet, a steel roofing material undergoes leakage at a bolt part connecting steel sheets due to a change in external environment such as a temperature change, a climate change, etc., and since the service life of the roofing material is 10 to 15 years or longer, the roofing material should have excellent durability due to environmental changes, and excellent various properties such as weatherability, an antimicrobial property, water resistance, thermal resistance and flame retardancy. Accordingly, a multi-layer composite thermoplastic elastomer-based roofing sheet capable of hot air welding has been used in recent years to compensate for the drawbacks of a steel sheet roofing material.

That is, a roofing sheet has a slightly different structure, but broadly consists of a fabric of a material for a backbone, and an olefin-based waterproof layer such as PVC or TPO, which is responsible for waterproofing, on a surface and the other surface of the fabric.

Meanwhile, in the case of a fabric included in a conventional roofing sheet, the winding property considerably decreases, defects are generated due to color migration to a fabric surface in coating work, and there are many defects such as weft removal in coating since fabric fixation is not properly performed.

Therefore, there is an urgent demand for developing a fabric which can exhibit an excellent winding property, excellent fabric fixability and excellent mechanical properties, and exhibit an effect of preventing dye migration in fabric coating.

SUMMARY OF THE INVENTION

To solve the above-described problems, the present invention is directed to providing a fabric having an excellent winding property, which has an excellent winding property, excellent fabric fixability and excellent mechanical properties and exhibits an effect of preventing dye migration in fabric coating, and a commodity including the same.

To solve the above-described problems, the present invention provides a fabric having an improved winding property, which includes warp; weft; ground warp included to interweave the warp and the weft; and fusion parts which are included at both ends in the warp discharging direction, and are formed by bonding one type of low melting fiber selected from a core-sheath type first low melting fiber which includes a first sheath and a first core and a core-sheath type second low melting fiber which includes a second sheath having a lower melting point or softening point than the first sheath and a second core.

According to an exemplary embodiment of the present invention, the warp and weft may be disposed to be interwoven, and the ground warp may be included to interweave the warp and the weft, or the weft may be disposed under the warp, and the ground warp may be included to interweave the warp and the weft.

In addition, each of the warp and the weft may independently include one or more selected from the group consisting of polyester fiber and PP fiber.

In addition, the warp and the weft may each independently have a fineness of 250 to 3000 De.

In addition, the ground warp may include one or more selected form the group consisting of polyester fiber and PP fiber.

In addition, the ground warp may include one or more selected from the group consisting of a first low melting fiber and a second low melting fiber.

In addition, the ground warp may have a fineness of 50 to 300 De.

In addition, the first low melting fiber and the second low melting fiber may each independently a fineness of 50 to 300 De.

In addition, the first sheath may have a melting point or softening point of 150° C. or less, and the second sheath may have a melting point or softening point of 130° C. or less.

In addition, the first core, first sheath, second core and second sheath may include polyester fiber.

In addition, the fusion parts may be included at a distance of 0.1 to 1 cm inward from both ends in the warp discharging direction.

In addition, 4 to 24 threads of the warp per inch in the warp direction may be included, and 4 to 32 threads of the weft per inch in the weft direction may be included.

In addition, the present invention provides a commodity having an improved winding property, which include the above-described fabric having an improved winding property.

According to an exemplary embodiment of the present invention, the commodity may be one or more selected from the group consisting of a roofing sheet, a fabric for advertisement, a fabric for transportation and an awning.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, embodiments of the present invention will be described in detail so that those of ordinary skill in the art can easily carry out the present invention. However, the present invention may be implemented in a variety of different forms, and is not limited to the embodiments described herein.

Figure 1:
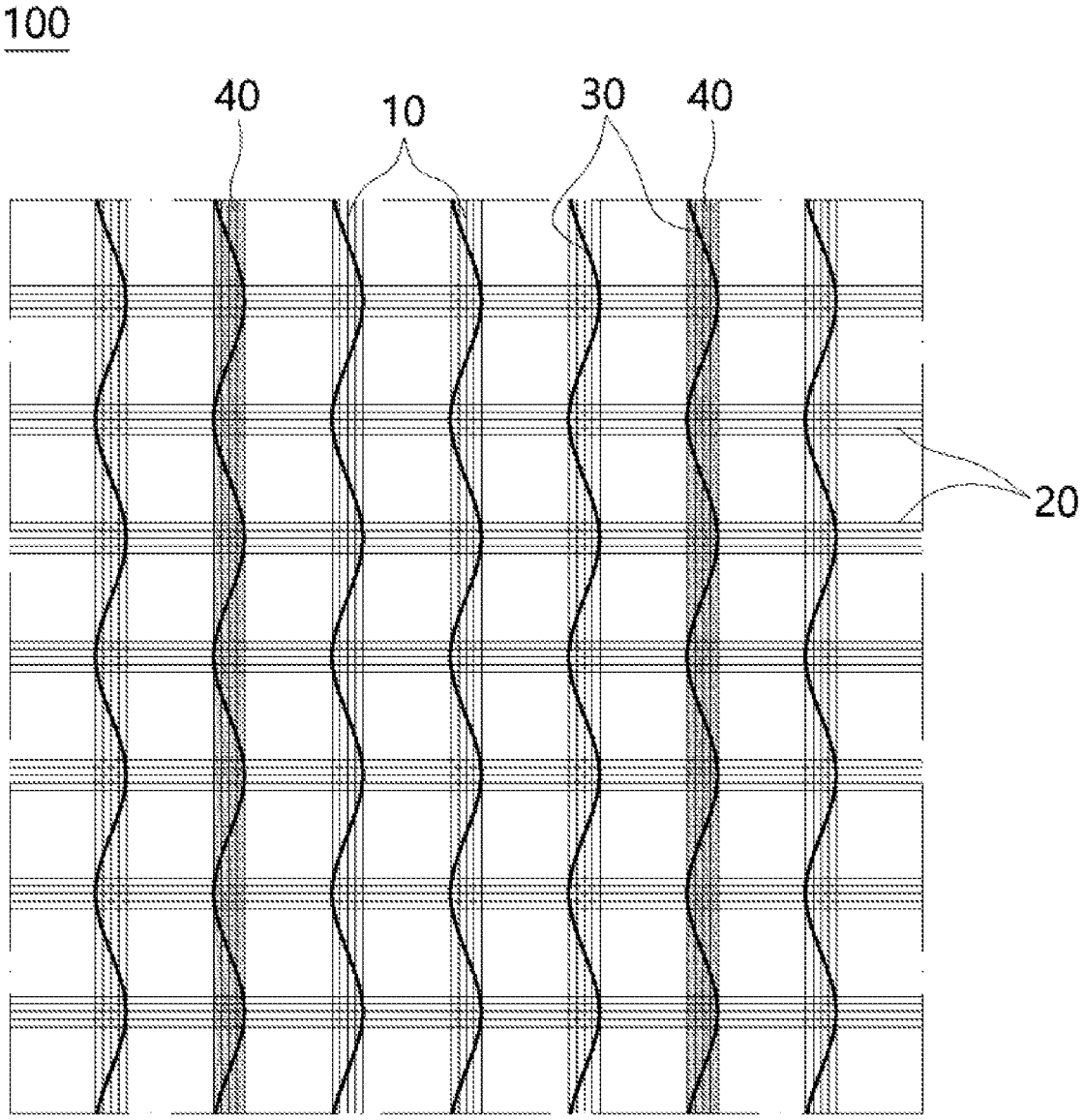
FIG. 1 is a top view schematically showing a fabric with an improved winding property according to an exemplary embodiment of the present invention.
Figure 2:
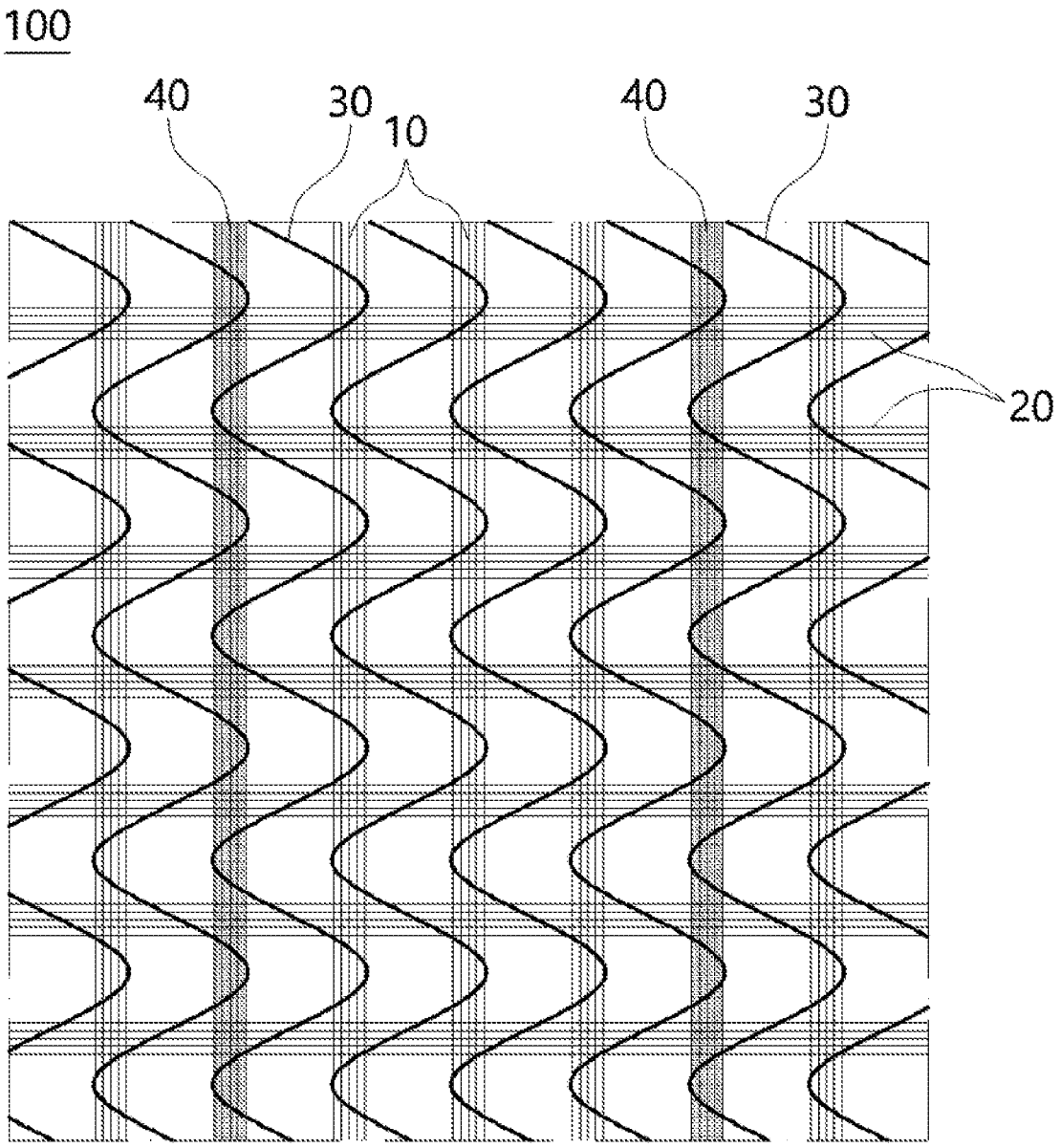
FIG. 2 is a top view schematically showing a fabric with an improved winding property according to another exemplary embodiment of the present invention.

Referring to FIGS. 1 and 2, a fabric 100 having an improved winding property according to an exemplary embodiment of the present invention includes warp 10; weft 20; ground warp 30 included to interweave the warp and the weft; and fusion parts 40 which are included at both ends in a direction of discharging the warp, and are formed by bonding one type of low melting fiber selected from a core-sheath type first low melting fiber which includes a first sheath and a first core and a core-sheath type second low melting fiber which includes a second sheath having a lower melting point or softening point than the first sheath and a second core.

First, the warp 10 will be described.

The warp 10 may be used without limitation as long as it is a fiber that can be generally used in the art, and preferably includes one or more selected from the group consisting of polyester fiber and PP fiber, and more preferably polyester fiber.

In addition, the warp 10 may be formed of a mono yarn or a plurality of filaments, and preferably, a fiber formed of a plurality of filaments in terms of insulation performance.

The warp 10 is not limited as long as it has a fineness that can be generally used in the art, preferably a fineness of 250 to 3000 De, and more preferably a fineness of 300 to 2800 De. When the fineness of the warp is less than 250 De, the mechanical properties of the fabric having an improved winding property may decrease, and when the fineness of the warp is more than 3000 De, the winding property may decrease.

Next, the weft 20 will be described.

The weft 20 may be used without limitation as long as it is a fiber that can be generally used in the art, and preferably includes one or more selected from the group consisting of polyester fiber and PP fiber, and more preferably polyester fiber.

The weft 20 is not limited as long as it has a fineness that can be generally used in the art, preferably a fineness of 250 to 3000 De, and more preferably a fineness of 300 to 2800 De. When the fineness of the weft is less than 250 De, the mechanical properties of the fabric having an improved winding property may decrease, and when the fineness of the weft is more than 3000 De, the winding property may decrease.

Next, the ground warp 30 included to interweave the warp 10 and the weft 20 will be described.

According to an exemplary embodiment of the present invention, the ground warp 30 may include one or more selected from the group consisting of polyester fiber and PP fiber, according to anther exemplary embodiment of the present invention, the ground warp 30 may include one or more selected from the group consisting of a first low melting fiber and a second low melting fiber, which will be described later, and according to still another exemplary embodiment of the present invention, the ground warp 30 may be used in combination with one or more selected from the group consisting of polyester fiber and PP fiber and one or more selected from the group consisting of a first low melting fiber and a second low melting fiber.

Due to the inclusion of the ground warp 30, voids in the fabric having an improved winding property may be reduced, and accordingly mechanical properties may be excellent.

The ground warp 30 is not limited as long as it has a fineness that can be generally used in the art, preferably a fineness of 50 to 300 De, and more preferably a fineness of 55 to 280 De. When the fineness of the ground warp is less than 50 De, the fabric fixability and mechanical properties of the fabric having an improved winding property may decrease, and when the fineness of the ground warp is more than 300 De, the winding property may decrease.

Next, fusion parts 40 included at both ends in a direction of discharging the warp 10 and formed by bonding a low melting fiber will be described.

As the fabric 100 having an improved winding property according to the present invention includes the fusion parts 40, it may overcome conventional problems of a decreased winding property and defects caused by dye migration, and may exhibit excellent mechanical properties.

The fusion parts 40 may be formed by fusing low melting fibers, and the low melting fiber may include one selected from the group consisting of a first low melting fiber and a second low melting fiber, and preferably, a second low melting fiber. In this case, since the process may be performed at a relatively low temperature, excellent workability may be exhibited, and accordingly there is no damage to warp and weft according to a high temperature process, which may be more advantageous in terms of mechanical properties.

Here, the first low melting fiber has a core-sheath type structure including a first core and a first sheath, and the second low melting fiber has a core-sheath type structure including a second core and a second sheath. In addition, the second sheath has a lower melting point or softening point than the first sheath.

In addition, the first core and the second core may not be limited as long as it is a fiber that can be generally used in the art, and preferably, polyester fiber may be used. In addition, the first sheath and the second sheath are not limited as long as they are formed of a fiber that can be generally used to form a fusion part in the art, and preferably, polyester fiber may be used.

Meanwhile, the first sheath may have a melting point or softening point of 150° C. or less, and preferably, a melting point or softening point of 145° C. or less, and the second sheath may have a melting point or softening point of 130° C. or less, and preferably, a melting point or softening point of 125° C. or less. Here, as described above, it is obvious that the melting point or softening point of the first sheath is higher than that of the second sheath.

The first low melting fiber and the second low melting fiber are not limited as long as they each independently have a fineness that can be generally used in the art, preferably a fineness of 50 to 300 De, and more preferably 55 to 280 De. When the fineness of each of the first low melting fiber and the second low melting fiber is independently less than 50 De, the winding property may not be improved, and fabric fixability and mechanical properties may be degraded. When the fineness of each of the first low melting fiber and the second low melting fiber is more than 300 De, the winding property may be degraded.

The fusion parts 40 may be included at a distance of 0.1 to 1.0 cm, and preferably 0.3 to 0.8 cm inward from the warp 10 disposed at both ends in a direction of discharging the warp 10. When the fusion parts 40 do not satisfy the range of distance inward from the warp 10 disposed at both ends in a direction of discharging the warp 10, fabric fixability and/or the winding property may be degraded.

Meanwhile, FIGS. 1 and 2 are schematic diagrams drawn to help in understanding, and the warp number, the weft number and the ground warp number in the drawings may not be completely the same as those of a real fabric.

In addition, in a fabric 100 having an improved winding property according to an exemplary embodiment of the present invention, weft 20 may be disposed under warp 10, and ground warp 30 may be included to interweave the warp 10 and the weft 20.

In this case, the warp 10 and the weft 20 may not be interwoven, but may be woven by means of the ground warp 30.

Specifically, in the case of a knitted fabric manufactured of the fabric having an improved winding property according to the present invention, the fabric 100 having an improved winding property may be manufactured by disposing the weft 20 under the warp 10 to interweave the warp 10 and the weft 20, and as shown in FIGS. 1 and 2, disposing the ground warp 30 to interweave the warp 10 and the weft 20, and then forming the above-described fusion parts 40 at both ends in the warp discharging direction.

Alternatively, a fabric 100 having an improved winding property according to an exemplary embodiment of the present invention may include warp 10 and weft 20, which are disposed to be interwoven, and ground warp 30 to interweave the warp 10 and the weft 20.

Specifically, the fabric 100 having an improved winding property according to an exemplary embodiment of the present invention may be a textile manufactured by weaving, and the textile structure may be formed of any one selected from the group consisting of a plain weave, a twill weave, a satin weave and a double weave.

The plain weave, twill weave and satin weave are called three fundamental weaves, specific weaving techniques for the three fundamental weaves are conventional weaving methods. The textile may be formed by changing the structure on the basis of one of the three fundamental weaves, or combining several types of structures, for example, fancy plain weaves such as rib weave, basket weave, etc., fancy twill weaves such as broken twill weave, skip twill weave, pointed twill weave, etc., and fancy satin weaves such as irregular satin weave, added satin weave, extended satin weave, ottomeal satin weave, etc.

In the double weave, any one of warp and weft is a double yarn, or both of warp and weft are double yarns, and a specific method of manufacturing the double weave may be a conventional method of manufacturing a double weave.

However, there is no limit to a base material of the textile structure, and in weaving, warp and weft densities are not particularly limited.

Meanwhile, the fabric 100 having an improved winding property according to the present invention may include, per inch in the warp direction, 4 to 24 threads, and preferably 6 to 18 threads of the warp 10, and per inch in the weft direction, 4 to 32 threads, and preferably, 6 to 26 threads of the weft 20. When, in the fabric 100 having an improved winding property, there are less than 4 threads of the warp 10 per inch in the warp direction, or less than 4 threads of the weft 20 per inch in the weft direction, mechanical properties may be degraded. When there are more than 24 threads of the warp 10 per inch in the warp direction, or 32 threads of the weft 20 per inch in the weft direction, a winding property may be degraded.

Meanwhile, the present invention provides a commodity which includes the above-described fabric 100 having an improved winding property, and thus has an improved winding property.

The commodity is not limited as long as it is one to which the above-described fabric having an improved winding property can be applied, and may be, for example, one selected from the group consisting of a fabric for a roofing sheet, a fabric for advertisement, a fabric for transportation and a fabric for an awning, preferably, one selected from the group consisting of a roofing sheet, a fabric for advertisement, a fabric for transportation and an awning, and more preferably, a fabric for a roofing sheet.

The fabric having an improved winding property according to the present invention has an excellent winding property and excellent mechanical properties, and exhibits an effect of preventing foreign matter penetration after fabric coating.

Hereinafter, the present invention will be explained with reference to the following examples. Here, the examples are merely provided to exemplify the present invention, but the scope of the present invention is not limited by the following examples.

EXAMPLES

Example 1

Manufacture of Fabric Having Improved Winding Property

First, polyester fiber (PET, Hyosung) having a melting point of 255° C. and a fineness of 1300 De was provided as warp, and polyester fiber (PET, Hyosung) having a melting point of 255° C. and a fineness of 1300 De was provided as weft. A fabric was manufactured by providing the weft under the warp, and providing polyester fiber (68 De 9268, Hyosung) having a fineness of 68 De as ground warp to interweave the warp and the weft.

A fabric having an improved winding property, as shown in FIG. 2, was manufactured by disposing a second low melting fiber (Ezbon FDY SD, Toray Chemical) having a fineness of 80 De, which included a second core formed of polyester fiber and a second sheath formed of polyester fiber having a melting point of 120° C., on warp disposed at a distance of 0.4 cm inward from warp disposed at both ends in a warp discharging direction, and performing thermal treatment at 140° C. for 2 seconds to fuse the low melting fibers.

Here, 9 threads of the warp per inch in the warp direction were disposed, and 9 threads of the weft per inch in the weft direction were disposed.

Example 2

A fabric having an improved winding property was manufactured in the same manner as described in Example 1, except that a second low melting fiber, a first low melting fiber (Ezbon FDY SD, Toray Chemical) having a fineness of 70 De, which includes a first core formed of polyester fiber and a first sheath formed of polyester fiber having a melting point of 140° C. were provided, and thermally treated at 160° C.

Example 3

A fabric having an improved winding property was manufactured by interweaving the warp and the weft in the same manner as described in Example 1.

Examples 4 to 23 and Comparative Example 1

Fabrics having an improved winding property, as shown in Tables 1 to 4, were manufactured in the same manner as described in Example 1, except that a warp fineness, a weft fineness, a ground warp fineness, the fineness of a low melting fiber, the type of a low melting fiber, the distance of discharging a low melting fiber from warp disposed at both ends in the warp discharging direction, a warp number per inch in the warp direction, a weft number per inch in the weft direction and the presence or absence of a fusion part varied.

Comparative Example 2

A fabric having an improved winding property was manufactured in the same manner as described in Example 1, except that a PVC-coated yarn having a fineness of 720 De was used instead of a low melting fiber, and thermal treatment was not performed.

Experimental Example 1

Evaluation of Winding Property

A winding property was evaluated by winding each of the fabrics having an improved winding property manufactured according to Examples and Comparative Examples on a winding roller.

Here, the winding property of the fabric was evaluated as □ when the fabric was wound without any problem, ○ when the fabric was pushed less than 0.1° in the lateral direction while being wound on the winding roller, Δ when the fabric was pushed 0.1 to 0.5° in the lateral direction while being wound on the winding roller, and × when the fabric was pushed more than 0.5° in the lateral direction while being wound on the winding roller, and the evaluation results are shown in Tables 1 to 4 below.

Experimental Example 2

Evaluation of Tensile Strength

On the basis of specification ASTM D-5035 (Strip Method), the size of a sample for each of the fabrics having an improved winding property manufactured according to Examples and Comparative Examples was 25 mm (width)× 150 mm (length), and both ends of the sample was fixed with jigs. A tensile strength was evaluated by pulling the sample at a speed of 300 mm/min with a gauge length of 75 mm, and the results are shown in Tables 1 to 4 below.

Here, the tensile strength of 150 (lbf/2.5 cm) or more was evaluated as □, the tensile strength of 140 (lbf/2.5 cm) to less than 150 (lbf/2.5 cm) was evaluated as ○, the tensile strength of 130 (lbf/2.5 cm) to less than 140 (lbf/2.5 cm) was evaluated as Δ, and the tensile strength of less than 130 (lbf/2.5 cm) was evaluated as ×.

Experimental Example 3

Evaluation of Dye Migration

Dye migration was evaluated through visual inspection for confirming whether dye migration occurred when a commodity was manufactured by immersing each of the fabrics having an improved winding property according to Examples and Comparative Examples in a PVC coating solution and drying the fabric. Here, the manufacture of a commodity was performed a total of 10 times, and then the commodities were evaluated as ○ when there was no dye migration, and as × when there was dye migration. The results are shown in Tables 1 to 4 below.

Experimental Example 4

Evaluation of Coatability

After the coating described in Experimental Example 3 was performed on each of the fabrics having an improved winding property manufactured according to Examples and Comparative Examples, coatability was evaluated by confirming whether a phenomenon of warp and/or weft detachment occurred. Here, coatability was evaluated as ○ when there was no abnormality, and as × when a phenomenon of warp and/or weft detachment occurred after coating, and the results are shown in Tables 1 to 4 below.

TABLE 1

| Classification | | Example 1 | Example 2 | Example 3[1)] | Example 4 | Example 5 | Example 6 |
|---|---|---|---|---|---|---|---|
| Warp | Fineness (De) | 1300 | 1300 | 1300 | 150 | 3400 | 1300 |
| | Warp thread number per inch | 9 | 9 | 9 | 9 | 9 | 9 |
| Weft | Fineness (De) | 1300 | 1300 | 1300 | 1300 | 1300 | 150 |
| | Weft thread number per inch | 9 | 9 | 9 | 9 | 9 | 9 |
| Ground warp (GR warp) | Fineness (De) | 68 | 68 | 68 | 68 | 68 | 68 |
| Low melting fiber | Fineness (De) | 80 | 80 | 80 | 80 | 80 | 80 |
| | Melting point (° C.) | 130 | 150 | 130 | 130 | 130 | 130 |
| | Type | Second low melting fiber | First low melting fiber | Second low melting fiber | Second low melting fiber | Second low melting fiber | Second low melting fiber |

TABLE 1-continued

| Classification | | Example 1 | Example 2 | Example 3[1)] | Example 4 | Example 5 | Example 6 |
|---|---|---|---|---|---|---|---|
| | Distance from warp at both ends (cm) | 0.4 | 0.4 | 0.4 | 0.4 | 0.4 | 0.4 |
| Fabric having improved winding property | Winding property | ◎ | ◎ | ◎ | ◎ | Δ | ◎ |
| | Tensile strength | ◎ | ○ | ◎ | Δ | ◎ | Δ |
| Commodity (roofing sheet) | Evaluation of prevention of dye migration | ○ | ○ | ○ | ○ | ○ | ○ |
| | Coatability (fabric fixability) | ○ | ○ | ○ | ○ | ○ | ○ |

[1)]Example 3 indicates a woven fabric

TABLE 2

| Classification | | Example 7 | Example 8 | Example 9 | Example 10 | Example 11 | Example 12 |
|---|---|---|---|---|---|---|---|
| Warp | Fineness (De) | 1300 | 1300 | 1300 | 1300 | 1300 | 1300 |
| | Warp thread number per inch | 9 | 9 | 9 | 9 | 9 | 9 |
| Weft | Fineness (De) | 3400 | 1300 | 1300 | 1300 | 1300 | 1300 |
| | Weft thread number per inch | 9 | 9 | 9 | 9 | 9 | 9 |
| Ground warp (GR warp) | Fineness (De) | 68 | 30 | 340 | 68 | 68 | 68 |
| Low melting fiber | Fineness (De) | 80 | 80 | 80 | 30 | 55 | 280 |
| | Melting point (° C.) | 130 | 130 | 130 | 130 | 130 | 130 |
| | Type | Second low melting fiber | Second low melting fiber | Second low melting fiber | Second low melting fiber | Second low melting fiber | Second low melting fiber |
| | Distance from warp at both ends (cm) | 0.4 | 0.4 | 0.4 | 0.4 | 0.4 | 0.4 |
| Fabric having improved winding property | Winding property | Δ | ◎ | Δ | Δ | ◎ | ◎ |
| | Tensile strength | ◎ | Δ | ◎ | Δ | ◎ | ◎ |
| Commodity (roofing sheet) | Evaluation of prevention of dye migration | ○ | ○ | ○ | ○ | ○ | ○ |
| | Coatability (fabric fixability) | ○ | X | ○ | X | ○ | ○ |

TABLE 3

| Classification | | Example 13 | Example 14 | Example 15 | Example 16 | Example 17 | Example 18 |
|---|---|---|---|---|---|---|---|
| Warp | Fineness (De) | 1300 | 1300 | 1300 | 1300 | 1300 | 1300 |
| | Warp thread number per inch | 9 | 9 | 9 | 9 | 9 | 2 |

TABLE 3-continued

| Classification | | Example 13 | Example 14 | Example 15 | Example 16 | Example 17 | Example 18 |
|---|---|---|---|---|---|---|---|
| Weft | Fineness (De) | 1300 | 1300 | 1300 | 1300 | 1300 | 1300 |
| | Weft thread number per inch | 9 | 9 | 9 | 9 | 9 | 9 |
| Ground warp (GR warp) | Fineness (De) | 68 | 68 | 68 | 68 | 68 | 68 |
| Low melting fiber | Fineness (De) | 340 | 80 | 80 | 80 | 80 | 80 |
| | Melting point (° C.) | 130 | 130 | 130 | 130 | 130 | 130 |
| | Type | Second low melting fiber | Second low melting fiber | Second low melting fiber | Second low melting fiber | Second low melting fiber | Second low melting fiber |
| | Distance from warp at both ends (cm) | 0.4 | 0.03 | 0.3 | 0.8 | 1.3 | 0.4 |
| Fabric having improved winding property | Winding property | Δ | Δ | ◎ | ◎ | Δ | ◎ |
| | Tensile strength | ◎ | ◎ | ◎ | ◎ | ◎ | Δ |
| Commodity (roofing sheet) | Evaluation of prevention of dye migration | ○ | ○ | ○ | ○ | ○ | ○ |
| | Coatability (fabric fixability) | ○ | X | ○ | ○ | ○ | ○ |

TABLE 4

| Classification | | Example 19 | Example 20 | Example 21 | Example 22 | Example 23 | Comparative Example 1 | Comparative Example 2 |
|---|---|---|---|---|---|---|---|---|
| Warp | Fineness (De) | 1300 | 1300 | 1300 | 1300 | 1300 | 1300 | 1300 |
| | Warp thread number per inch | 18 | 30 | 9 | 30 | 9 | 9 | 9 |
| Weft | Fineness (De) | 1300 | 1300 | 1300 | 1300 | 1300 | 1300 | 1300 |
| | Weft thread number per inch | 9 | 9 | 3 | 26 | 40 | 9 | 9 |
| Ground warp (GR warp) | Fineness (De) | 68 | 68 | 68 | 68 | 68 | 68 | 68 |
| Low melting fiber | Fineness (De) | 80 | 80 | 80 | 80 | 80 | — | 720 |
| | Melting point (° C.) | 130 | 130 | 130 | 130 | 130 | — | PVC yarn |
| | Type | Second low melting fiber | Second low melting fiber | Second low melting fiber | Second low melting fiber | Second low melting fiber | — | |
| | Distance from warp at both ends (cm) | 0.4 | 0.4 | 0.4 | 0.4 | 0.4 | — | 0.4 |
| Fabric having improved winding property | Winding property | ◎ | Δ | ◎ | ◎ | Δ | X | ◎ |
| | Tensile strength | ◎ | ◎ | Δ | ◎ | ◎ | ◎ | ◎ |

TABLE 4-continued

| Classification | | Example 19 | Example 20 | Example 21 | Example 22 | Example 23 | Comparative Example 1 | Comparative Example 2 |
|---|---|---|---|---|---|---|---|---|
| Commodity (roofing sheet) | Evaluation of prevention of dye migration | ○ | ○ | ○ | ○ | ○ | ○ | X |
| | Coatability (fabric fixability) | ○ | ○ | ○ | ○ | ○ | X | ○ |

As shown in Tables 1 to 4, Examples 1 to 3, 11, 12, 15 and 16, which satisfy all of warp fineness, weft fineness, the fineness of ground warp, the fineness of a low melting fiber, the type of a low melting fiber, a low melting fiber discharging distance from warp located at both ends in the warp discharging direction, the warp number per inch in the warp direction, the weft number per inch in the weft direction, the presence of a fusion part and the presence of a PVC-coated yarn according to the present invention, compared to Examples 4 to 10, 13, 14, 17 to 23 and Comparative Examples 1 and 2 in which at least one parameter was not satisfied, showed an excellent winding property evaluation result and an excellent foreign matter penetration evaluation result.

Meanwhile, it can be confirmed that Example 2 exhibits a relatively lower tensile strength compared to Example 1, showing that thermal treatment at a relatively high temperature affects warp and/or weft.

Fabric having an improved winding property according to the present invention and a commodity including the same have an excellent winding property and excellent mechanical properties, and an effect of preventing dye migration in fabric coating.

Although exemplary embodiments of the present invention have been described above, the spirit of the present invention is not limited to the exemplary embodiments presented herein, and it will be understood by those of ordinary skill in the art that other exemplary embodiments may be easily suggested by adding, changing, deleting or adding components within the scope of the same idea and also included in the scope of the spirit of the present invention.

What is claimed is:

1. A fabric having an improved winding property, comprising:

warp;

weft;

ground warp included to interweave the warp and the weft; and fusion parts which are included at both ends in a warp discharging direction, and are formed by bonding one type of low melting fiber selected from a core-sheath type first low melting fiber which includes a first sheath and a first core and a core-sheath type second low melting fiber which includes a second sheath having a lower melting point or softening point than the first sheath and a second core.

2. The fabric of claim 1, wherein the warp and the weft are disposed to be interwoven and the ground warp is included to interweave the warp and the weft, or the weft is disposed under the warp and the ground warp is included to interweave the warp and the weft.

3. The fabric of claim 1, wherein the warp and the weft each independently include one or more selected from the group consisting of polyester fiber and PP fiber.

4. The fabric of claim 1, wherein the warp and the weft each independently have a fineness of 250 to 3000 De.

5. The fabric of claim 1, wherein the ground warp includes one or more selected from the group consisting of polyester fiber and PP fiber.

6. The fabric of claim 1, wherein the ground warp includes one or more selected from the group consisting of a first low melting fiber and a second low melting fiber.

7. The fabric of claim 1, wherein the ground warp has a fineness of 50 to 300 De.

8. The fabric of claim 1, wherein the first low melting fiber and the second low melting fiber each independently have a fineness of 50 to 300 De.

9. The fabric of claim 1, wherein the first sheath has a melting point or softening point of 150° C. or less, and the second sheath has a melting point or softening point of 130° C. or less.

10. The fabric of claim 1, wherein the first core, the first sheath, the second core and the second sheath include polyester fiber.

11. The fabric of claim 1, wherein the fusion parts are included 0.1 to 1 cm inward from warp disposed at both ends in a warp discharging direction.

12. The fabric of claim 1, which includes 4 to 24 threads of the warp per inch in the warp direction, and 4 to 32 threads of the weft per inch in the weft direction.

13. A commodity with an improved winding property, comprising the fabric having an improved winding property according to claim 1.

14. The commodity of claim 13, which is one selected from the group consisting of a roofing sheet, a fabric for advertisement, a fabric for transportation and an awning.

* * * * *